US007044508B2

(12) United States Patent
Burns et al.

(10) Patent No.: US 7,044,508 B2
(45) Date of Patent: May 16, 2006

(54) SHOELACE KNOT ASSISTING DEVICE

(76) Inventors: James Burns, 15 Tanglewood Dr., Summit, NJ (US) 07901; Andrew Fung, 221 Blackburn Rd., Summit, NJ (US) 07901

( * ) Notice: Subject to any disclaimer, the term of this patent is extended or adjusted under 35 U.S.C. 154(b) by 0 days.

(21) Appl. No.: 10/768,385

(22) Filed: Jan. 30, 2004

(65) Prior Publication Data

US 2005/0167986 A1 Aug. 4, 2005

(51) Int. Cl.
*B65H 69/04* (2006.01)

(52) U.S. Cl. ..... 289/1.5; 289/17; 289/18

(58) Field of Classification Search ..... 289/1.2, 289/1.5, 2, 13, 17, 18.1; 36/112, 136; 24/712, 24/712.1, 712.2, 712.3, 712.4, 712.5, 712.6, 24/713; 434/260, 397
See application file for complete search history.

(56) References Cited

U.S. PATENT DOCUMENTS 528,464 A * 10/1894 Craig ..... 24/712.2
4,291,439 A * 9/1981 Riti ..... 24/712.2
4,428,101 A * 1/1984 Harkavy ..... 24/712.4
4,553,293 A * 11/1985 Blum ..... 24/712.2
4,571,854 A * 2/1986 Edens ..... 36/50.1
4,780,936 A * 11/1988 Brecher ..... 24/712.2
4,805,270 A * 2/1989 Kimbrough ..... 24/712.3
5,372,510 A * 12/1994 Stanfield ..... 434/260
5,459,947 A * 10/1995 Lasher ..... 36/54
5,778,500 A * 7/1998 Illingworth ..... 24/712.3
5,913,483 A * 6/1999 Polk ..... 24/712.3
5,979,028 A * 11/1999 Hicks et al. ..... 24/712.9
6,247,214 B1 * 6/2001 Hyde ..... 24/712.6
6,588,078 B1 * 7/2003 Writt et al. ..... 24/712.2

* cited by examiner

*Primary Examiner*—Gary L. Welch
(74) *Attorney, Agent, or Firm*—Ward & Olivo

(57) ABSTRACT

The present invention is a device for assisting users in tying their shoelaces properly. The device will help users tie bow-type knots by securing the initial crossover knot in place while the complete bow-type knot is being tied. The device can be used by children learning how to tie shoelace knots or by any person who is having difficulty tying shoelaces.

17 Claims, 2 Drawing Sheets

SHOELACE KNOT ASSISTING DEVICE

TECHNICAL FIELD OF THE INVENTION

The present invention relates to a device which will help children and others tie their shoelaces properly and/or improve their shoelace tying skills. The device will help shoe wearers become more proficient at tying their shoelace knots securely, particularly but not exclusively using the conventional bow-type knots.

BACKGROUND OF THE INVENTION

Tying shoelaces is generally a two-step process. First, the laces are tied tightly into a crossover knot that is meant to hold down the tongue of the shoe and hold the laces threaded through the shoe tightly. Second, the shoe wearer will generally form a loop with each lace and tie those loops together on top of the first crossover knot, to make a bow-type knot. There are, of course, other methods known for tying a bow-type knot, but they have at least one thing in common: tying the knot securely is a two-step process. The crossover knot must first be secured, and then the bows for the bow-type knot must be tied together. Certain segments of the population, including young children, the elderly, and individuals with certain disabilities often have problems learning and/or performing these steps satisfactorily.

A common difficulty encountered by children is that their shoelaces are not tied tightly enough, so they come undone unintentionally. Shoelace knots that are tied too loosely can result in injury. Children's feet can slip out of their shoes because their shoelaces are not tied tight enough, or loose shoelace knots could come completely undone and increase the likelihood that a child will trip over the untied laces.

The genesis of these problems is oftentimes a crossover knot that is too loose. In the process of tying a shoe, sometimes the crossover knot comes loose or undone while the shoe wearer is trying to complete the second, bow-type knot.

A class of technology exists which contains devices for securely holding laces already tied in a bow-type knot. These devices secure the finished bow-type knot so that the laces do not come undone until the wearer removes the device—i.e., they are designed to secure a bow-type knot after it is securely tied in the first place. These devices, however, are not designed or concerned with ensuring that the crossover knot is created correctly and tied tightly in the first place. None of the devices known to the applicants assist with tying the first, crucial crossover knot properly, or keeping that knot securely tied until the shoe wearer has successfully made the bows and tied the bow-type knot over the crossover knot.

Thus, there is a clear need for a device which can assist children and others in tying their shoelace knots properly, so that their shoelaces are tied firmly around their feet and their shoelace knots are tight.

SUMMARY OF THE INVENTION

The present invention consists of a means for securing the shoelaces in the middle of the tying process. As previously discussed, the process of tying conventional bow-type knots is composed of two steps. The user must first assemble a crossover knot, then the user must form loops from the shoelace ends and tie these loops over the crossover knot to form a bow-type knot. As previously discussed, there are various known methods for completing the second step. The present invention will hold the crossover knot in place while the laces are being manipulated in preparation for and during the tying of the bow-type knot.

Though the primary objective of the present invention is to aid children in tying shoelaces properly, the device could be used by any person who is having difficulties tying shoelace knots, such as persons with certain disabilities. The use of the term "child" or "children" is not meant to limit the application of the device to certain users. Any mention of children in conjunction with the present invention is only for convenience and clarity, and is meant to serve as a reference for people who may be challenged by tying shoelace knots. In addition, the term "shoe" is meant to include every type of footwear that includes laces which need to be tied. Any mention of the terms "shoe" or "shoes" in conjunction with the present invention is only for convenience and clarity.

The present invention will assist children by securing the crossover knot in the middle of the tying process, allowing the children to complete tying the second step of the bow-type knot tightly, no matter how long it takes or how much they squirm in their shoes. This will lead to fewer instances of dangerously loose shoelaces or insecure shoelace knots. The shoelace knot assisting device will help children confidently complete the bow-type knot without having to worry about their crossover knot coming loose or undone. The invention is directed towards a method and means to help children and others tie shoelaces properly by securing the shoelaces in the middle of the tying process (i.e., after the crossover knot has been made), which will allow individuals to perform the final steps (creating and tying the bows for the bow-type knot) more easily.

Thus, it is an object of the present invention to help people tie their shoelace knots properly.

These and other objects will become apparent to one skilled in the art after review of the following description, figures, and claims.

BRIEF DESCRIPTION OF THE DRAWINGS

A preferred embodiment of the present invention is illustrated in the accompanying drawings in which.

DESCRIPTION OF THE PREFERRED EMBODIMENT

As required, a detailed illustrative embodiment of the present invention is disclosed herein. However, techniques, systems and operating structures in accordance with the present invention may be embodied in a wide variety of forms and modes, some of which may be quite different from those in the disclosed embodiment. Consequently, the specific structural and functional details disclosed herein are merely representative, yet in that regard, they are deemed to afford the best embodiment for purposes of disclosure and to provide a basis for the claims herein which define the scope of the present invention. The following presents a detailed description of a preferred embodiment (as well as some alternative embodiments) of the present invention.

Figure 1:
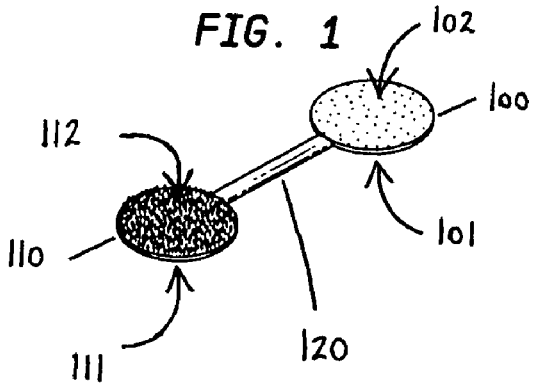
FIG. 1 shows the device before it has been attached to a shoe.

Referring now to the drawings in greater detail, FIG. 1 illustrates the shoelace knot assisting device alone. The device is composed of a first tab 100 and a second tab 110 which both have an outer and inner surface. The two tabs are attached to each other by a cord 120. The cord could be composed of various materials such as elastic fabrics, rubber materials, leather, canvas, or other textile materials. Elastic and non-elastic materials are both contemplated. Also, tensioning means, such as buckles, could be employed to ensure a secure hold.

The outer surface 101 of the first tab 100 is secured to the tongue of the shoe. The device of the present invention can be attached to the tongue of the shoe through various means. If the device is sold together with a shoe, then the first tab of the device could be sewn, stapled, or glued directly onto the tongue of the show. If the device is sold separately from a shoe, then there are various methods for attaching the first tab of the device to a shoe tongue after sale. These methods could include adhesive materials (such as cyanoacrylate, methacrylate, epoxy, or acrylic adhesives), a sewing means, or various types of staples, fasteners, clips, clamps, or tying devices. Therefore, tabs could be secured to the tongue permanently (through sewing or other means) or tabs could be less fixably attached so that they can be removed and reattached to the tongue at will.

The inner surface 102 of the first tab 100 contains an adhesive material or device (such as, for example, a VELCRO®-like hook material) so that it is facing away from the tongue of the shoe. The inner surface 112 of the second tab 110 contains a material or is otherwise designed to receive the adhesive material from the inner surface of the first tab (for example, a VELCRO®-like loop material) so that the inner surfaces of the two tabs fasten securely to each other when brought into contact. Means for securing the two tabs could include buttons, snaps, latches or any other suitable means known in the art of fastening. To increase the appeal of the device to children, a decorative element may be attached to the outer surface 111 of the second tab 110, facing away from the shoe when the two tabs are connected. The decoration could include almost any design, such as cartoon images, flowers, sports items, stars, animals, words, logos, or a happy face.

Figure 2:
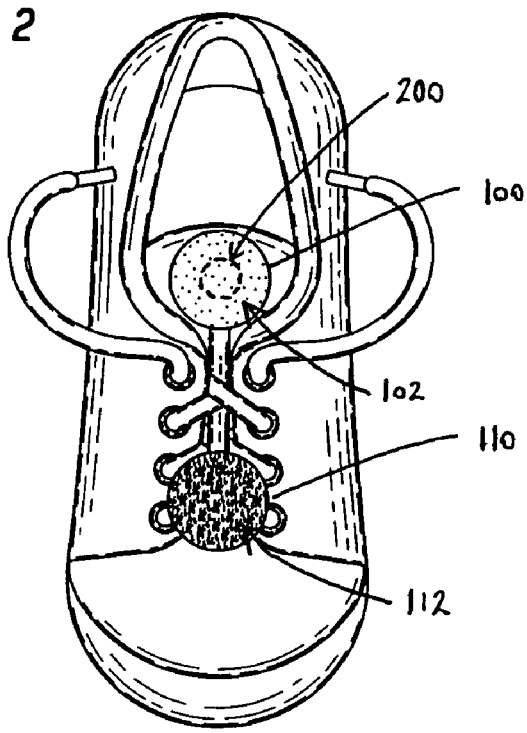
FIG. 2 shows the device attached to the tongue of a shoe before the shoelaces have been tied.

FIG. 2 shows the shoelace knot assisting device attached to the tongue of a shoe before the shoelaces have been tied. The first tab 100 of the device is secured to the shoe tongue so that it cannot be lost even when the shoelaces have been untied. The dotted region 200 illustrates the area hidden from view where a means of securing the outer face of the first tab 100 can be applied to secure the device to the tongue of a shoe. The adhesive material or device is attached to the inner surface 102 of the first tab 100, so that the adhesive material or device will not come in contact with the shoelaces and damage their fabric. The receiving material or device is attached to the inner surface 112 of the second tab 110.

Figure 3:
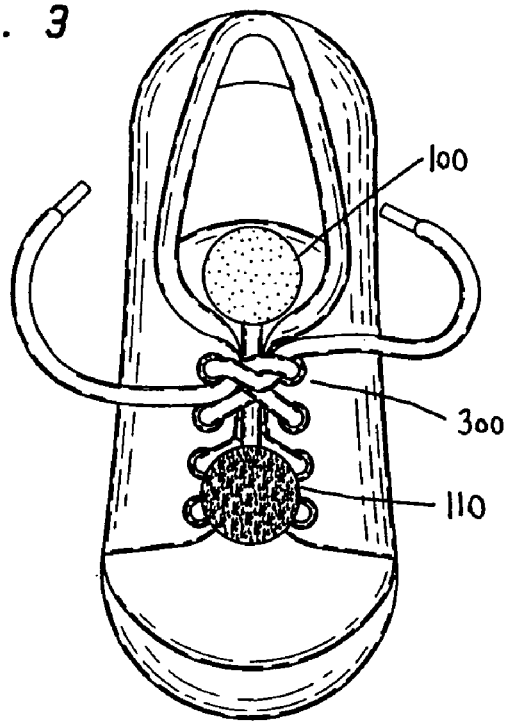
FIG. 3 shows the device after the crossover knot has been tied.

FIG. 3 shows the device in the middle of the shoelace tying process, but before the device has been put to use. The crossover knot 300 (i.e., the first step in tying the completed bow-type knot) has been completed.

Figure 4:
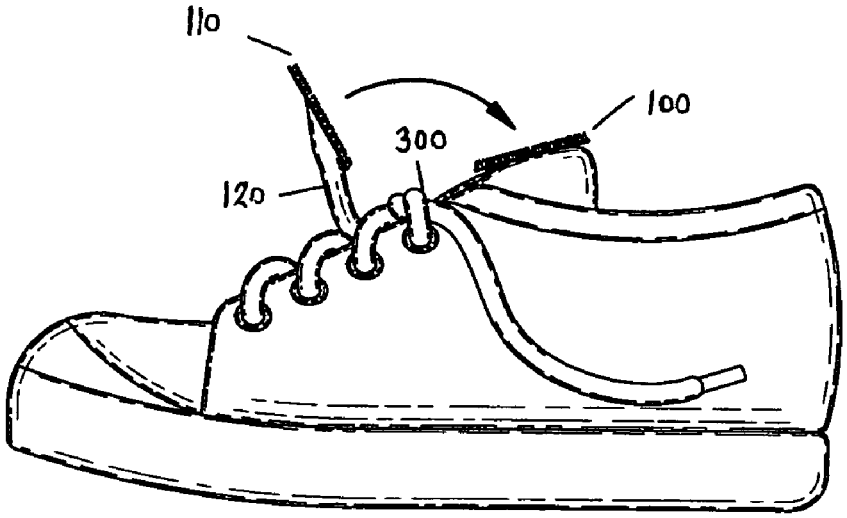
FIG. 4 shows the device securing the crossover knot in place so that the bow-type knot can be tied properly.

FIG. 4 shows the device as it is about to secure the shoelaces in the middle of the shoelace tying process. The first tab 100 and second tab 110 of the device are about to be connected so that the cord will hold the crossover knot 300 in place. Once the crossover knot has been fastened, the child can concentrate on completing the bow-type knot without worrying about the crossover knot coming undone. If the crossover knot is not loose to begin with, it will be less likely to come undone later.

The cord 120 of the device is preferably thin enough to allow the bow-type knot to be tied on top of it. Most of the existing shoelace fastening devices of which the applicants are aware are concerned with further securing an already-tied bow-type knot, and they contain elastic bands or strips which are too thick to securely tie a bow-type knot on top of them. Therefore, they cannot be used to secure knots in the middle of the tying process.

Figure 5:
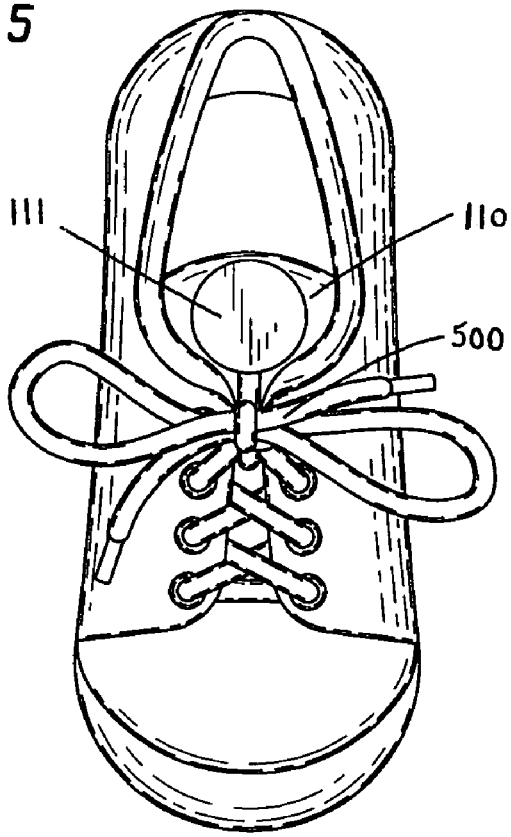
FIG. 5 shows the completed bow-type knot with the device in place.

FIG. 5 shows the completed bow-type knot 500 with the shoelace knot assisting device in place. The outer surface 111 of the second tab 110 can contain a decorative element which can accommodate various types of artwork, or may contain no artwork at all. A decorative element may make the device more attractive to children, some of whom might otherwise prefer not to use the device.

While the present invention has been described with reference to a preferred embodiment (as well as some variants thereof), which have been set forth in considerable detail for the purposes of making a complete disclosure of the invention, such embodiment is merely exemplary and is not intended to be limiting or to represent an exhaustive enumeration of all aspects of the invention. The scope of the invention, therefore, shall be defined solely by the following claims as attached or as subsequently amended. Further, it will be apparent to those of skill in the art that numerous changes may be made in such details without departing from the spirit and the principles of the invention.

Having described the preferred embodiment of the invention, we claim:

1. An apparatus to aid in the process of tying shoelaces comprising:

a first tab which has both an inner and outer surface;

a second tab which has both an inner and outer surface;

a cord which is attached to said first tab on the first end of said cord and to said second tab on the second end of said cord;

wherein said cord allows a knot to be tied on top of it;

a means for securing said outer surface of said first tab to the tongue of a shoe;

a means for securing said inner surface of said first tab together with said inner surface of said second tab.

2. An apparatus according to claim 1 wherein the means for securing said first tab to said tongue of a shoe is comprised of thread material.

3. An apparatus according to claim 1 wherein the means for securing said first tab to said tongue of a shoe is selected from the group consisting of staples, fasteners, clips, clamps, and tying devices.

4. An apparatus according to claim 1 wherein the means for securing said first tab to said tongue of a shoe is comprised of an adhesive material selected from the group consisting of cyanoacrylate, methacrylate, epoxy, and acrylic adhesives.

5. An apparatus according to claim 1 where said cord is made of a material selected from the group consisting of elastic material, fabric material, rubber material, and non-elastic material (leather, canvas, or other textile material).

6. An apparatus according to claim 1 wherein the means for securing said first tab to said second tab is comprised of hook and loop material.

7. An apparatus according to claim 1 where said outer surface of said second tab has a decorative element attached thereto.

8. A method to aid in the process of tying shoelaces comprising the steps of:

tying a crossover knot with said shoelaces;

securing said crossover knot with a cord;

wherein said cord allows a knot to be tied on top of it;

tying a bow-type knot on top of said crossover knot and said cord.

9. A method according to claim 8 where said cord is made of a material selected from the group consisting of elastic material, fabric material, rubber material, and non-elastic material (leather, canvas, or other textile material).

10. A method according to claim 8 where said step of securing comprises the steps of:

providing a first tab which has both an inner and outer surface;

providing a second tab which has both an inner and outer surface;

providing a means for securing said inner surface of said first tab together with said inner surface of said second tab;

providing a means for securing said outer surface of said first tab to the tongue of a shoe.

11. A method according to claim 10 wherein the means for securing said first tab to said tongue of a shoe is comprised of thread material.

12. A method according to claim 10 wherein the means for securing said first tab to said tongue of a shoe is selected from the group consisting of staples, fasteners, clips, clamps, and tying devices.

13. A method according to claim 10 wherein the means for securing said first tab to said tongue of a shoe is comprised of an adhesive material selected from the group consisting of cyanoacrylate, methacrylate, epoxy, or acrylic adhesives.

14. A method according to claim 10 wherein the means for securing said first tab to said second tab is comprised of hook and loop material.

15. A method according to claim 10 where said outer surface of said second tab has a decorative element attached thereto.

16. An apparatus to aid in the process of tying shoelaces comprising:

a means for securing a crossover knot while a bow-type knot is being formed and tied;

a means for attaching the apparatus to the tongue of a shoe.

17. A device for securing shoelaces while they are being tied consisting of a means for securing the shoelaces in a crossover knot while the bow-type knot is being tied.

* * * * *